US007877939B2

(12) United States Patent
Knapp

(10) Patent No.: US 7,877,939 B2
(45) Date of Patent: Feb. 1, 2011

(54) FASTENING DEVICE WITH IMPROVED FASTENING PORTION FOR SECUREMENT OF A GLASS PANE OR A PLATE IN A FRAME

(76) Inventor: Friedrich Knapp, Baldhamer Strasse 18, 85591 Vaterstetten (DE)

( * ) Notice: Subject to any disclaimer, the term of this patent is extended or adjusted under 35 U.S.C. 154(b) by 118 days.

(21) Appl. No.: 11/910,669

(22) PCT Filed: Apr. 4, 2006

(86) PCT No.: PCT/DE2006/000600

§ 371 (c)(1),
(2), (4) Date: Oct. 1, 2008

(87) PCT Pub. No.: WO2006/105774

PCT Pub. Date: Oct. 12, 2006

(65) Prior Publication Data

US 2009/0031651 A1 Feb. 5, 2009

(30) Foreign Application Priority Data

Apr. 4, 2005 (DE) ..... 10 2005 015 457

(51) Int. Cl.
*E06B 3/54* (2006.01)

(52) U.S. Cl. ..... 52/204.53; 52/204.55; 52/204.591; 52/285.1

(58) Field of Classification Search ..... 52/204.53, 52/204.591, 285.1, 204.55
See application file for complete search history.

(56) References Cited

U.S. PATENT DOCUMENTS 3,632,146 A * 1/1972 Buzby et al. ..... 52/285.2
6,151,849 A * 11/2000 Twigg et al. ..... 52/208
6,715,245 B2 * 4/2004 Lewkowitz ..... 52/208
D599,194 S * 9/2009 Meyer et al. ..... D8/354
2007/0256375 A1 * 11/2007 Fountas ..... 52/204.53

FOREIGN PATENT DOCUMENTS

DE 42 16 260 A1 10/1993

(Continued)

*Primary Examiner*—Richard E Chilcot, Jr.
*Assistant Examiner*—Alp Akbasli
(74) *Attorney, Agent, or Firm*—Henry M. Feiereisen; Ursula B. Day

(57) ABSTRACT

The invention relates to a fastening means for preferably fastening a glass pane (12) in a frame structure made of wood or plastic material. The fastening means according to the invention is characterized by the following elements: several angular clamping pieces (1) and a holding rail (9), wherein each of the angular clamping pieces comprises two legs extending perpendicularly to each other and the vertical leg comprises a plate-like fastening portion (4), which extends from the center part thereof outwardly at a predetermined distance to the horizontal leg and is shorter than the angular clamping piece itself, wherein the holding rail (9) extending along the glass pane is provided in its longitudinal direction with a groove (10), the with thereof matching to the thickness of the fastening portion, and wherein, in the mounted state, the glass pane contacts at its backside the stop provided in the frame (11), several angular clamping pieces are tightly pressed to the front side of the glass pane and fixed by fixing elements (7), and the holding rail (9) is pressed onto the fastening portion (4) by its longitudinal groove (10).

8 Claims, 2 Drawing Sheets

FOREIGN PATENT DOCUMENTS

| | | | |
|---|---|---|---|
| DE | 195 25 206 | A1 | 1/1996 |
| DE | 296 00 399 | U1 | 2/1996 |
| DE | 199 55 639 | A1 | 5/2001 |
| GB | 2 290 577 | A | 1/1996 |
| GB | 2 345 938 | A | 7/2000 |

* cited by examiner

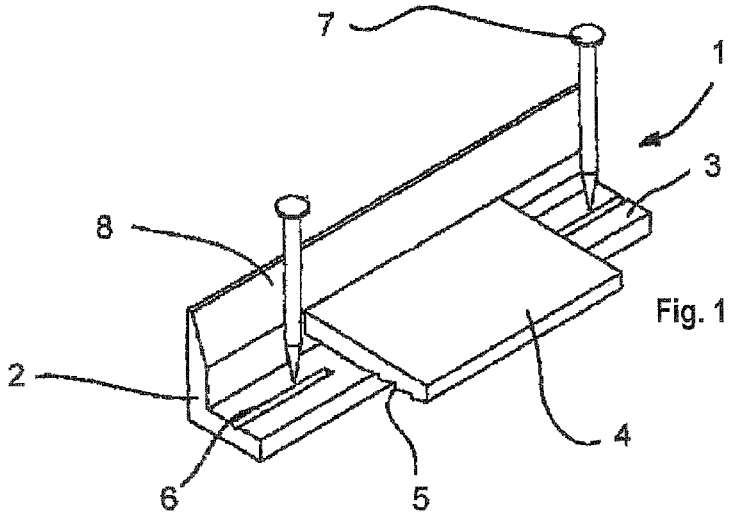
Fig. 1
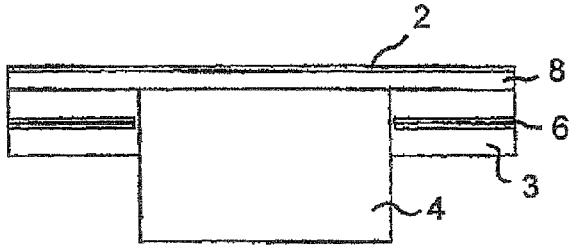
Fig. 1A
Fig. 1B
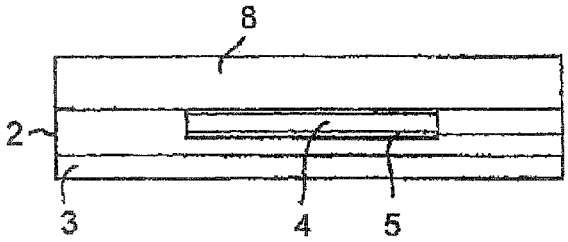
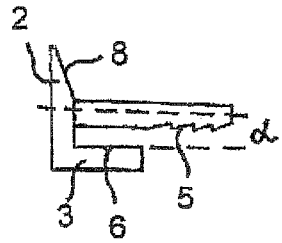
Fig. 1C
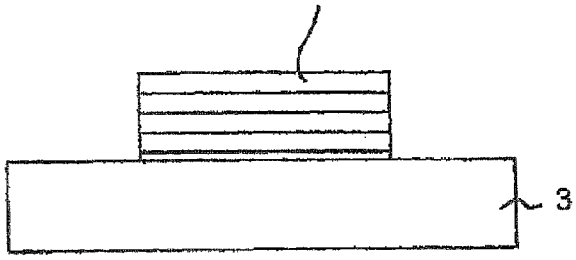
Fig. 1D

FASTENING DEVICE WITH IMPROVED FASTENING PORTION FOR SECUREMENT OF A GLASS PANE OR A PLATE IN A FRAME

BACKGROUND OF THE INVENTION

The present invention relates to a device for fastening glass panes, preferably, in a frame made of wood or plastic material. For fastening glass panes or plates in doors, glass cupboards etc., compound arrangements of ledges are used, such as described in the documents DE 195 25 206, DE 296 00 399 U1, DE 42 16 260 C2 and DE 199 55 639 A1.

Frequently, it is desirable that such compound arrangements of ledges are easily releasable so that a broken glass pane can be exchanged very quickly, for example. This is ensured by a compound arrangement of ledges described in DE 296 00 399 U1, but conditionally only. FIG. 5 of this document shows an embodiment according to the prior art, which will be described in the following. A profiled ledge 6, 7 each is arranged on the edges of a recess in a door-plate 3, which are held together by a connecting element 1. A glass pane 2 is fitted between the ledges 6, 7 without any clearance. The connecting element 1 comprises two holding legs 9, 10, each of which being inserted into a groove 11, 12 of the corresponding ledge 6, 7. Preferably, each of the holding legs 9, 10 is provided with a projection 16 which is pressed between the side walls of the grooves 11, 12 of the ledges 6, 7 to work like a dowel pin when the connecting element 1 is mounted. The connecting element is provided with a hole 14 at its middle portion 8, through which a countersink bolt 15 is screwed into the door-plate 3 to fix the connecting element 1.

To exchange the mounted glass pane 2 for another one, at least one of the profiled ledges 6, 7 is drawn from a holding leg 9, 10 and re-mounted again. With the detachable compound arrangement of ledges describes above, there is the possibility for the ledges 6 or 7 to be loosened or even removed by winds loading the glass pane 2 alternately or by accelerative forces occurring when the door is closed. Moreover, mounting of ledges is relatively costly.

In practice, another problem is to hold a glass pane in its position tightly and reliably, which can not be ensured satisfactorily by all of the solutions known up to know.

SUMMARY OF THE INVENTION

Therefore, object of the invention is to provide a detachable fastening device which prevents the profiled ledge from loosening even after a plurality of exchanges of glass pane or after loading an installed glass pane by compression and accelerative forces continuously. Furthermore, mounting should be possible very simply.

This object is solved by a fastening means for fastening a glass pane or a plate in a frame having a greater thickness than the glass pane or the plate, wherein the frame comprises a one-sided stop opposite to its backside and the fastening means is includes several angular clamping pieces and a holding rail, wherein each of the angular clamping pieces comprises two legs extending perpendicularly to each other and the vertical leg, which extends above the horizontal leg at a predetermined distance to it, comprises a plate-like fastening portion, and the holding rail extending along the glass pane or the plate to be fastened comprises in its longitudinal direction a groove, the width of which matching to the thickness of the fastening portion, wherein, in the mounted state, the backside of glass pane or plate contacts the stop, several angular clamping pieces are tightly pressed to the front side of glass pane or plate and fixed to the frame by means of fastening elements, and the holding rail is fixed by its longitudinal groove pressed over the fastening portions, wherein the fastening portion is shorter than the angular clamping piece itself and is arranged approximately in midsection in relation to a length extension of the angular clamping piece.

This fastening device is suited for a frame provided with a stop near the backside thereof and is used to press a thin plate such as a conventional glass pane or a multi-layer glass pane to the stop from the front side and hold it in its position. At first, several angular clamping pieces are pressed to the glass pane or plate and fixed. The angular clamping pieces comprise two legs extending perpendicularly to each other. The vertical leg has a plate-like fastening portion which extends laterally above the horizontal leg in a predetermined distance to it.

A holding rail having a length corresponding to that of the glass pane and provided with a groove is pushed onto the fastening portions arranged to each other on the same level. The fastening device is easily mountable, low in cost and reliable even if the wind load changes.

According to the invention, the fastening portion is shorter than the angular clamping piece itself and arranged approximately in the middle part thereof so that a portion of the horizontal leg of the angular clamping piece at its right side and its left side is not covered by the fastening portion. This feature of the invention is very advantageous compared with the prior art.

In order to give the fastening device a high stability, two factors should be considered. A first factor is to fasten the horizontal leg by means of a nail, a pin or a bolt as close as possible to the glass pane, i.e., the fastening element has to be driven or screwed in as close as possible to the glass pane. A second factor is to give the fastening portion a great length. However, when the fastening portion is designed too long, it would cover the horizontal leg so that there is no possibility to insert fixing elements from above. A nail can only be driven into the horizontal leg without restrictions, i.e. without spatial limitations as close as possible to the glass pane, when the fastening portion is shorter than the angular clamping piece itself. However, in the direction away from the glass pane, the fastening portion can be dimensioned relatively long and thus, the groove correspondingly deep so that the holding rail is fixed in a stable manner.

According to another feature of the invention, the fastening portion is slightly inclined towards the horizontal leg of the angular clamping piece. The fastening portion and the groove in the holding rail are dimensioned so that the fastening portion is slightly deflected upwardly when the holding rail is pushed onto it and is brought into a stressed state. Thus, the pre-stressed fastening portion acts through its bottom surface onto the holding rail and presses it to the frame reliably. By this advantageous further development of the invention, a still more reliable fixing of the holding rail is gained.

According to another feature of the invention, the portions of the horizontal leg on the right and on the left side of the fastening portion are provided with a centering aid for inserting pin-like fixing elements. The shape of these centering aid is dependent on the technical limiting conditions of assembling and can be a groove or a hole. This centering aid ensures that the fixing elements are always inserted at a predetermined position.

According to another feature of the invention, the lower surface of the fastening portion is provided with a holding profile which enables the holding rail to be pushed onto the fastening portion easily, but makes the removal therefrom difficult. Such profiles known as pine-cone or saw-tooth profiles act on the barb principle thereby further enhancing a fastening of the holding rail.

According to another feature of the invention, the vertical leg of the angular clamping piece is tapered at its top portion to form a pointed end. When the holding rail is mounted and has reached its final position, the gap formed between it and the top portion of the vertical leg is sufficiently great to fill in a sealing material such as silicone gum.

According to another feature of the invention, the angular clamping piece is made of a resilient plastic material which has a relatively great strength and can be punched by nails without causing problems.

BRIEF DESCRIPTION OF THE DRAWING

In the following, the invention will be described with reference to the accompanying drawings.

FIG. 1 shows a perspective view and another four views of an angular clamping piece;

FIG. 1A shows a top view of the clamping piece of FIG. 1;

FIG. 1B shows a front view of the clamping piece of FIG. 1;

FIG. 1C shows a side view of the clamping piece of FIG. 1;

FIG. 1D shows a bottom view of the clamping piece of FIG. 1;

DETAILED DESCRIPTION OF PREFERRED EMBODIMENTS

Figure 2:
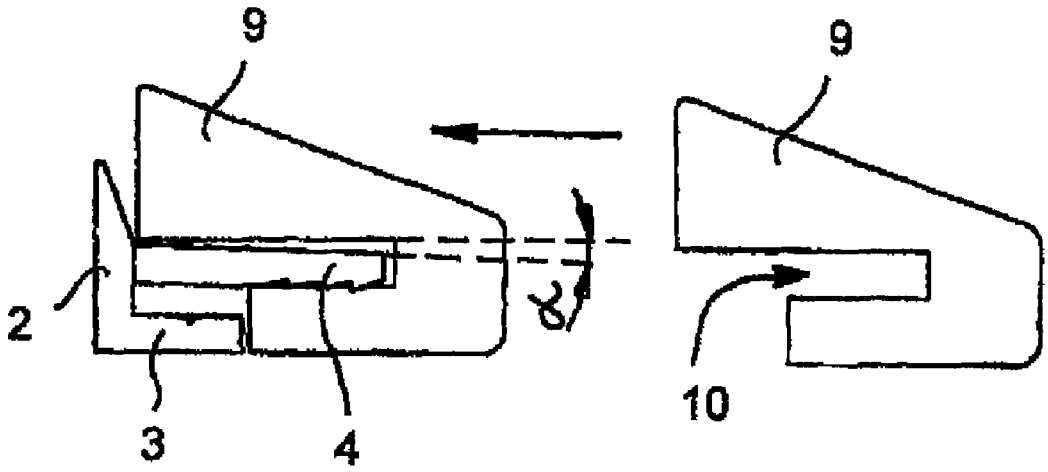
FIG. 2 shows in which way a holding rail is mounted to the angular clamping piece.

As recognizable from FIG. 1, the angular clamping piece 1 comprises a vertical leg 2 and a horizontal leg 3. A fastening portion 4 extends from the vertical leg 2, which has a predetermined distance to the horizontal leg 3 and is slightly inclined downwards it by a predetermined angle $\alpha$. The lower surface of the fastening portion 4 is provided with a profile similar to that of a fir-cone.

As also recognizable from FIG. 1, the fastening portion 4 is shorter in length than the legs of the angular clamping piece 1. Those portions of the horizontal leg 3, which are not covered by the fastening portion 4, are provided with grooves 6 into which nails 7, for example, can be driven at a predetermined position. The vertical leg 2 comprises a taper cone 8, the meaning thereof being recognizable from FIG. 3.

Portions of the angular clamping piece, which are outlined in the top view, the side view, the front view and the bottom view and which correspond to those in the perspective view, are marked by the same signs.

FIG. 2 shows in which way a holding rail 9 is pushed onto the fastening portion 4 of the angular clamping piece 1. The holding rail 9 is provided with a groove 10, the width of which matching to the thickness of the fastening portion 4. As also recognizable from FIG. 2, the fastening portion is inclined by an angle $\alpha$ of about 3 degrees, but preferably by an angle $\alpha$ between 3 and 6 degrees.

Figure 3:
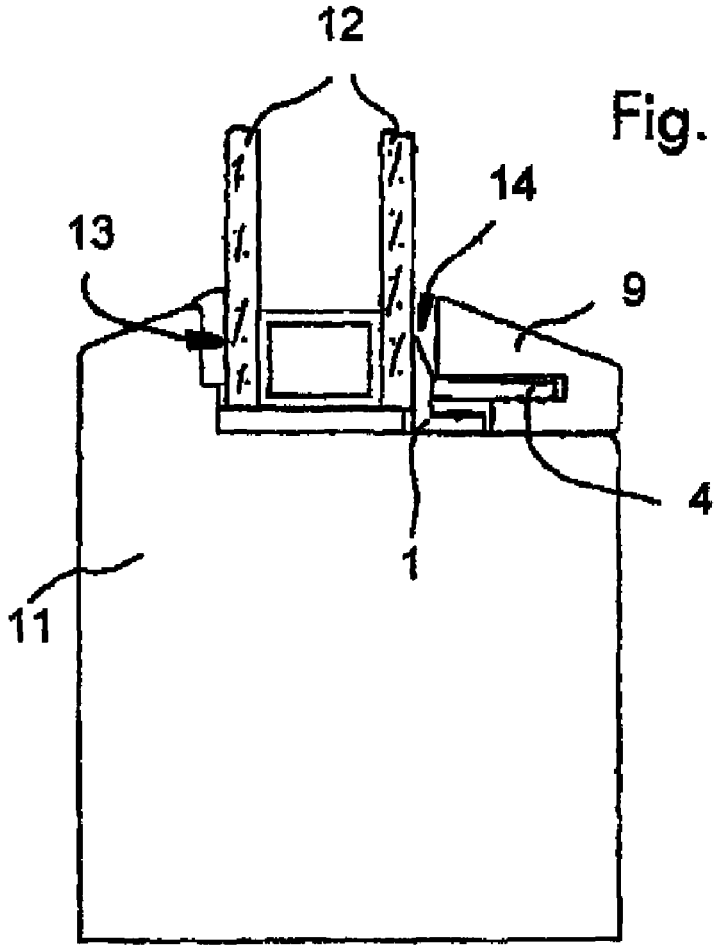
FIG. 3 shows in which way the invention is used to hold a multi-layer glass pane in a frame.

FIG. 3 shows in which way the invention is used for holding a multi-layer glass pane 12 in a frame 11. As recognizable from FIG. 3, a multi-layer glass pane 12 contacts at its backside the stop 13. An angular clamping piece 1 is fixed on the front side, which presses the multi-layer glass pane 12 to the stop 13. In addition, the holding rail 9 is pressed onto the fastening portion 4 and, thereby, is reliably clamped by the measures described above. When mounting is completed, the gap 14 formed by the taper cone 8 is filled with a sealing material such as silicone.

What is claimed is:

1. A fastening device for fastening a glass pane or a plate in a frame having a greater thickness than the glass pane or the plate, said fastening device comprising:

an angular clamping piece having two legs extending perpendicularly to each other to define a vertical leg and a horizontal leg, wherein the vertical leg has a plate-like fastening portion which extends above the horizontal leg at a predetermined distance thereto; and a holding rail extending along the glass pane or the plate to be fastened and including a longitudinal groove defined by a width which matches a thickness of the fastening portion, wherein, in the mounted state, a backside of glass pane or plate contacts a one-sided rear stop of the frame, several angular clamping pieces are tightly pressed to a front side of glass pane or plate and fixed to the frame by means of fastening elements, and the holding rail is pressed with the longitudinal groove over the fastening portion, wherein the fastening portion has a length, which is shorter than a length of the angular clamping piece, and is arranged approximately in midsection in relation to a length extension of the angular clamping piece, and wherein the fastening portion is slightly inclined towards the horizontal leg of the angular clamping piece.

2. The fastening device of claim 1, further comprising a centering aid to the left and right adjacent the fastening portion in the horizontal leg for inserting pin-like fastening elements.

3. The fastening device of claim 1, wherein the vertical leg of the angular clamping piece is tapered upwardly to form a pointed end.

4. The fastening device of claim 1, wherein the angular clamping piece is made of a firm resilient plastic material.

5. A fastening device for fastening a glass pane or a plate in a frame having a greater thickness than the glass pane or the plate, said fastening device comprising:

an angular clamping piece having two legs extending perpendicularly to each other to define a vertical leg and a horizontal leg, wherein the vertical leg has a plate-like fastening portion which extends above the horizontal leg at a predetermined distance thereto; and a holding rail extending along the glass pane or the plate to be fastened and including a longitudinal groove defined by a width which matches a thickness of the fastening portion, wherein, in the mounted state, a backside of glass pane or plate contacts a one-sided rear stop of the frame, several angular clamping pieces are tightly pressed to a front side of glass pane or plate and fixed to the frame by means of fastening elements, and the holding rail is pressed with the longitudinal groove over the fastening portion, wherein the fastening portion has a length, which is shorter than a length of the angular clamping piece, and is arranged approximately in midsection in relation to a length extension of the angular clamping piece, and wherein a lower surface of the fastening portion is provided with a profile which enables the holding rail to be pushed onto the fastening portion and to impede a removal therefrom.

6. The fastening device of claim 5, further comprising a centering aid to the left and right adjacent the fastening portion in the horizontal leg for inserting pin-like fastening elements.

7. The fastening device of claim 5, wherein the vertical leg of the angular clamping piece is tapered upwardly to form a pointed end.

8. The fastening device of claim 5, wherein the angular clamping piece is made of a firm resilient plastic material.

* * * * *